US007757348B2

(12) United States Patent
Salice

(10) Patent No.: US 7,757,348 B2
(45) Date of Patent: Jul. 20, 2010

(54) FURNITURE HINGE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 301 days.

(21) Appl. No.: 11/817,591

(22) PCT Filed: Jan. 2, 2007

(86) PCT No.: PCT/EP2007/050003

§ 371 (c)(1),
(2), (4) Date: Aug. 31, 2007

(87) PCT Pub. No.: WO2007/077232

PCT Pub. Date: Jul. 12, 2007

(65) Prior Publication Data

US 2008/0201904 A1 Aug. 28, 2008

(30) Foreign Application Priority Data

Jan. 4, 2006 (IT) ..... RM20060001 U

(51) Int. Cl.
*E05F 1/08* (2006.01)

(52) U.S. Cl. ..... 16/286; 16/54

(58) Field of Classification Search ..... 16/286–288, 16/50, 54, 56, 82, 294, DIG. 21; 188/268, 188/276, 290, 291, 296, 322.5
See application file for complete search history.

(56) References Cited

U.S. PATENT DOCUMENTS 3,362,510 A * 1/1968 Nash ..... 188/290
4,449,269 A * 5/1984 Sundermeier et al. ..... 16/50
4,550,470 A * 11/1985 Omata ..... 16/85
6,298,960 B1 * 10/2001 Derr ..... 188/290
7,003,851 B2 * 2/2006 Salice ..... 16/285
7,127,778 B2 * 10/2006 Salice ..... 16/354
2006/0026792 A1 * 2/2006 Brustle et al. ..... 16/54
2007/0136990 A1 * 6/2007 Salice ..... 16/282

FOREIGN PATENT DOCUMENTS

DE 10121977 A1 11/2002
DE 10211294 A1 9/2003

* cited by examiner

*Primary Examiner*—Chuck Y. Mah
(74) *Attorney, Agent, or Firm*—Gifford, Krass, Sprinkle, Anderson & Citkowski, P.C.

(57) ABSTRACT

Furniture hinge with damping and/or braking device in alternative to those already existing and capable of guaranteeing an improved efficiency during the closing or opening operation of the doors, or other furniture parts, thanks to an improvement of the characteristics of rigidity and, simultaneously, elasticity of the means for transmitting motion from one of the rockers to the damping elements. The improved efficiency of this hinge is also obtained by increasing the friction surfaces with a viscous medium present in suitable areas of the hinge and by allowing regulation of the trend of the angular velocity of a circular shaped element, for example a disc, which acts as braking element in contact with the viscous medium.

10 Claims, 4 Drawing Sheets

Fig. 3
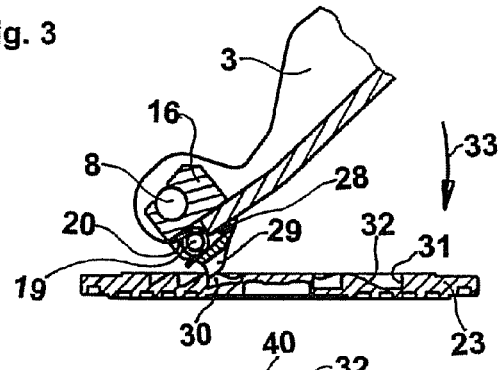
Fig. 5
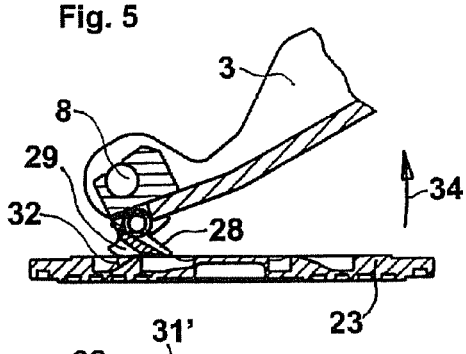
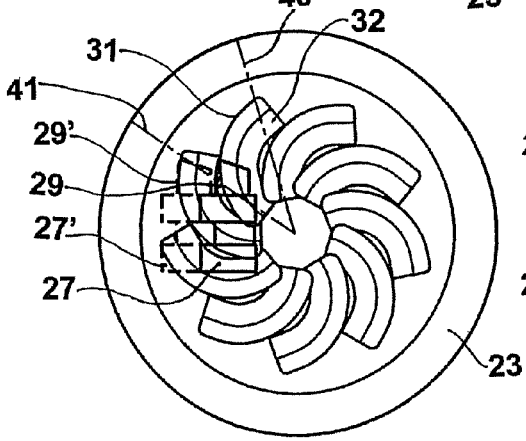
Fig. 4
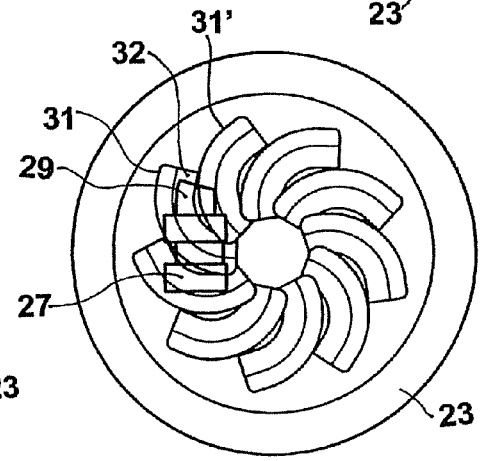
Fig. 6
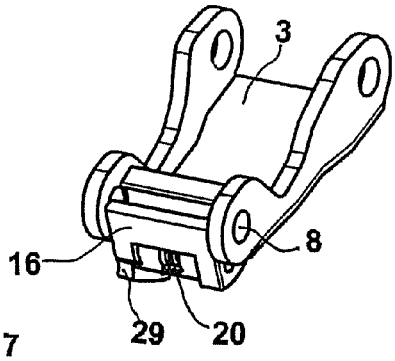
Fig. 7
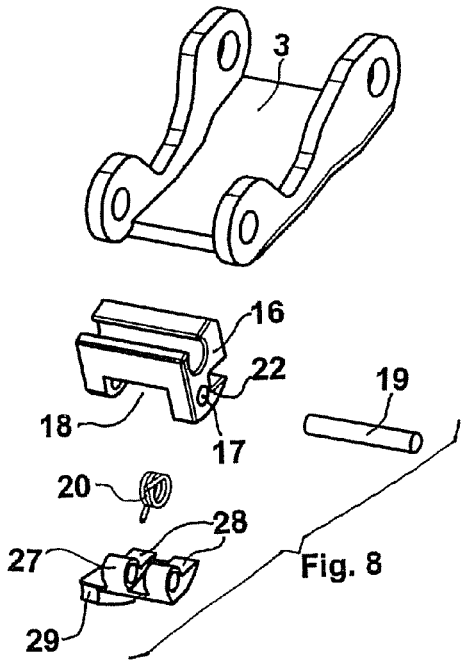
Fig. 8

FURNITURE HINGE

FIELD OF THE INVENTION

The present invention relates to a furniture hinge, in particular a hinge with spring for doors, or in general for furniture parts suitable to be brought into motion, provided with a damping device which acts during opening and/or closing of the doors.

STATE OF THE ART

Furniture provided with doors or wings to close compartments and which open by pivoting about a horizontal or vertical axis uses various types of hinge. A type which is very widely used today is one in which the hinges to support the doors in the closed position are not visible from the outside of the piece of furniture when the door is closed.

Hinges of this type are today commonly used in the furniture industry as they have a series of advantages, which have determined their extensive use on the market. Some embodiments of known hinges are provided with springs of various types to produce a return force during closing or a pushing force during opening of the doors to which they are fitted. This allows very precise closing or opening of the doors.

Nonetheless, damping and/or braking devices of the door movement caused by the elastic reaction of the spring are desirable in these hinges. The object of these devices is above all to prevent noise caused during closing operations by doors banging shut against the body of the piece of furniture.

There are currently various known damping and braking devices integrated in furniture hinges. However, these devices have some drawbacks.

In particular, in some hinges motion is transmitted by one of the rockers to the damping elements of the damping device by the use of a slider, substantially rectangular in shape. This slider must reconcile two opposing characteristics: on the one hand it must have good rigidity so that the lower surface thereof meshes as much as possible without deformations in the grooves of the damping elements, and on the other hand it must have sufficiently elasticity to allow bending during the return movement thereof to exceed the edges of these grooves without allowing said damping elements to rotate. If the working and coupling tolerances of the components are not sufficiently precise, this can lead to poor operation of the damping device due to irregular behaviour or to possible idle travel of the slider. Therefore, there is a need to produce a hinge provided with damping device which is capable of overcoming the aforesaid drawbacks.

SUMMARY OF THE INVENTION

The main object of the present invention is to produce a furniture hinge with a damping and braking device in alternative to those already existing, guaranteeing an improved efficiency during the closing and/or opening operation of the doors, or other furniture parts, thanks to an improvement of the characteristics of rigidity and, simultaneously, elasticity of the means for transmitting motion from one of the rockers to the damping elements.

A further object is to simplify the device, without variation to the overall dimensions of standard hinges.

Therefore, the present invention proposes to resolve the problems discussed above by producing a furniture hinge with damping device which, according to claim 1, comprises a first member for fixing to an element of a piece of furniture, a second member for fixing to a door of said element of piece of furniture, comprising a box, said first member being suitable to move with a relative pivoting motion about a first articulation pin with said box, connections means for connecting said first member to damping means for damping said pivoting motion, comprising a damping element immersed in a viscous medium so as to produce a damping force, the hinge being characterized in that said connection means comprise a hook element suitable to pivot about a respective articulation pin, with axis parallel to said first articulation pin, and elastic means suitable to exert a pushing force on said hook element so that the latter exerts a pressure on the damping element, and in that said hook element is suitable to engage a curved groove of a plurality of curved grooves, present on a first face of the damping element so as to convert the pivoting motion of the first member about the first pivoting pin into a rotational motion of said damping element about its own centre in correspondence with a rotation of the hinge.

Advantageously, the hinge of the invention comprises a more simple damping device, without the rectangular shaped slider. The element to transmit motion between rocker, in the case of a quadrilateral hinge, or between fixing arm, in the case of single pin hinge, and the damping elements is advantageously produced on a hook pivoting about a pin housed on a cam connection element fixed to said rocker or fixing arm.

The configuration of this pivoting hook and the presence of an elastic element, such as a torsion spring, optimally satisfy the respective requirements of rigidity and elasticity which the slider of known damping devices is not always capable of satisfying.

The improved efficiency of the hinge of the present invention is obtained also by increasing the friction surfaces with a viscous medium present in suitable areas of the hinge and allowing regulation of the trend of the angular velocity of the disc which acts as braking element in contact with the viscous medium.

Another advantage is represented by the fact that the damping device of the hinge of the invention forms a separate element which can be mounted, already assembled, with extreme ease on the base of a box element, or simply box, of standard type. In fact, as in the hinge of the invention the box element is separated from the damping device, it does not contribute towards the damping actions and can be produced with standard materials, for example simply by stamping, and does not require the use of more costly materials particularly suitable for damping.

From a production viewpoint all this implies that on a first production line it is possible to continue producing standard type hinges, while assembly of the damping device on said hinges, when required, is performed separately on a second independent line. Consequently, it is unnecessary to provide lines dedicated entirely to the production of hinges with integrated damping device.

Moreover, while assembly of state of the art hinges provides for subsequent mounting on the box element of the elements forming the damping device one at a time, in the hinge of the invention said device, already assembled separately, is mounted on the base of the box of the hinge with a single, simple and quick operation. The box element therefore does not act as supporting element during mounting of the elements of the damping device.

In an advantageous embodiment, fixing of said device to the box is performed using the same two pins forming the articulation of the hinge rockers with the box, in the case of a hinge of the articulated quadrilateral type, or using the single pin forming the articulation of the fixing arm with the box, in the case of a single pin hinge.

The standard box element is advantageously provided with an opening on the base thereof and has a shape suitable for quick assembly with the damping device. Moreover, in order to produce hinges provided with damping device it is sufficient for one of the two rockers, or the fixing arm directly, to be provided on the first production line with a connection element capable of interacting, through the opening on the base of the box element, with the braking disc of the damping device. This connection element can, for example, be formed by one end of the same rocker or by the same fixing arm or by a separate element however connected to the rocker or to the fixing arm, or inserted thereon and pivoting about the respective pin.

Finally, a further advantage is that said damping device, thanks to its compactness and being mounted on the base of the box element, is incorporated inside the thickness of the furniture door and is therefore invisible when the door is opened, also improving the aesthetic appearance.

The dependent claims describe preferred embodiments of the invention.

BRIEF DESCRIPTION OF THE FIGURES

Further characteristics and advantages of the invention will be more apparent in the light of the detailed description of preferred, although non-exclusive, embodiments of a furniture hinge with damping device illustrated, by way of a non-limiting example, with the aid of the accompanying drawings wherein:

FIGS. 3 and 5 respectively show a sectional view of a detail of the hinge in FIG. 1 in two different positions;

FIGS. 4 and 6 show plan views of the inside of a detail of the hinge corresponding respectively to the two positions in FIGS. 3 and 5;

FIG. 7 shows a perspective view of a second assembled component of the hinge in FIG. 1;

FIG. 8 shows an exploded view of the second component in FIG. 7.

DETAILED DESCRIPTION OF PREFERRED EMBODIMENTS OF THE INVENTION

Figure 1A:
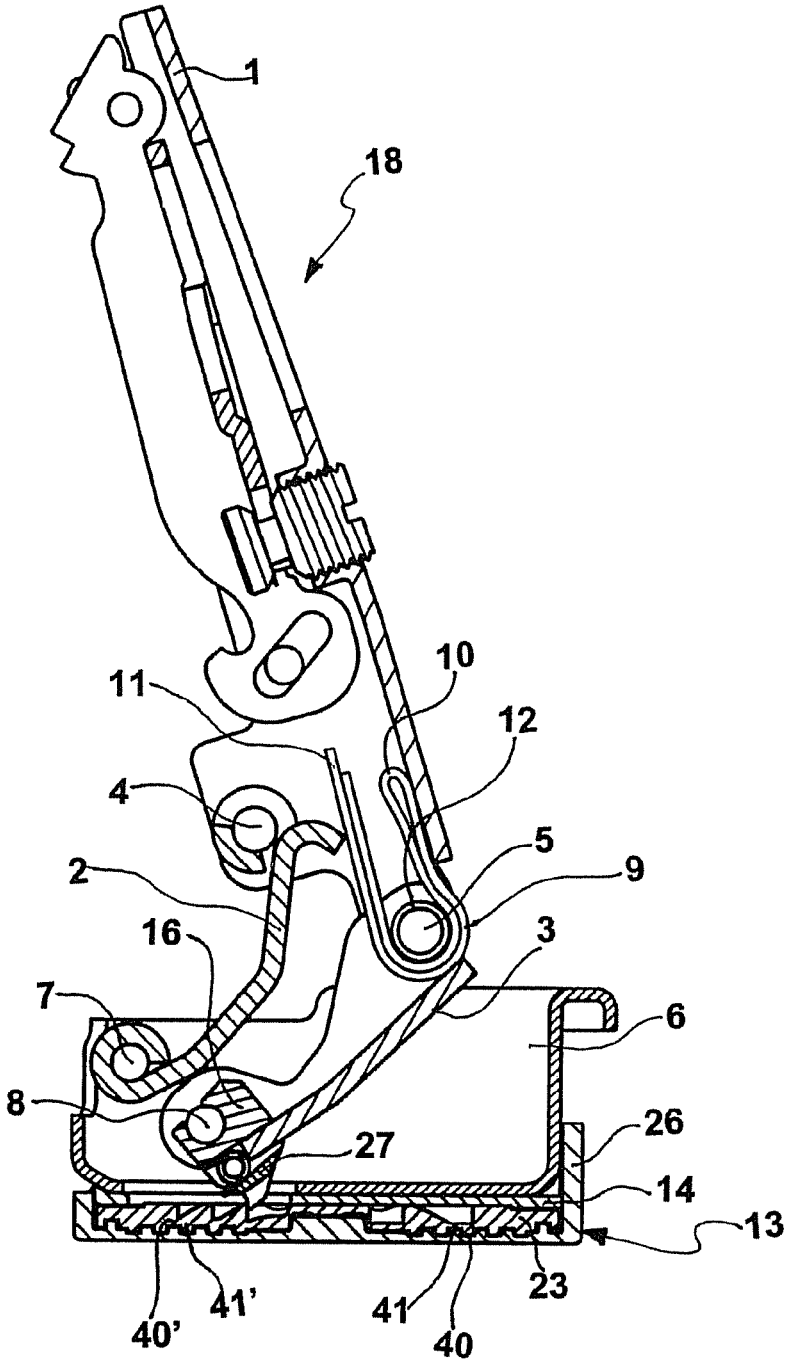
FIG. 1*a* shows a sectional view of the hinge of the invention in a half-open position.

With reference to FIG. 1*a*, a hinge is represented, indicated as a whole with the reference 18, comprising a fixed element, or hinge arm 1, which is fixable on a base, or plate, in turn fixed integrally to a bearing wall of a side panel or any suitable element of a piece of furniture. The hinge is provided with two rockers 2 and 3, with a respective first end thereof pivoting about two respective pins 4, 5 housed in holes in the side walls of the arm 1. The arm 1 is connected to a box element 6, fixed in a cavity produced in the inside wall of the door or wing of the piece of furniture, or of any other appropriate pivoting element of the piece of furniture. The two respective second ends of the rockers 2 and 3 are housed in rotation on other two respective pins 7, 8 with axes parallel to the first two pins 4, 5. The four pins 4, 5, 7, 8 form an articulated quadrilateral.

Around the articulation pin 5, connecting the rocker 3 to the arm 1, there is provided an elastic element or spring 9. One of the arms 10 of said elastic element is resting on the hinge arm 1, while the other arm 11 reacts on the rocker 2.

Closing of the arms 10, 11 of the elastic element 9 is established so that this element 9 exerts a pushing force on the rocker 2 until the position shown in FIG. 1. Beyond this opening angle of the door, approximately from 15 to 20°, the elastic element 9 has a compression with a negligible application arm, so that the remaining part of the pivoting movement of the door takes place freely without being influenced by the presence of elastic forces.

On the other hand, in the closing phase of the door, the elastic element produces a return force in the closing direction which allows a precise and spontaneous closing of the door in the final angular space, with an amplitude of approximately 15 to 20°.

A bushing 12 can be appropriately interposed between the elastic element 9 and the pin 5. Alternatively, the element 9 can be detached from the pin 5 and be anchored in a known way to the hinge arm 1.

On the base of the box element 6 there is mounted advantageously a damping and/or braking device 13 suitable to reduce releases which take place during the opening and/or closing phases of the doors, reducing noise and allowing these phases to take place comfortably and smoothly.

Figure 2:
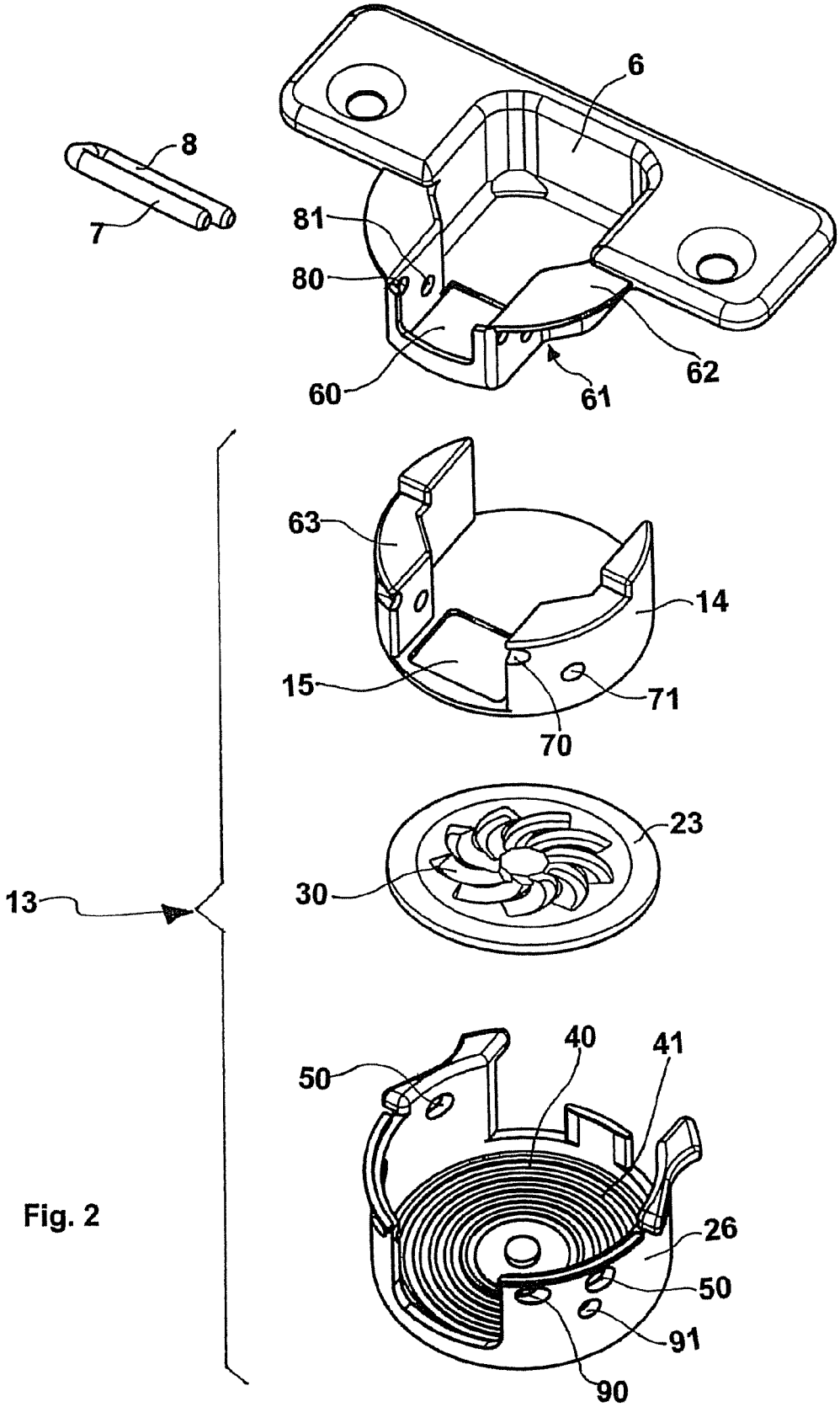
FIG. 2 shows an exploded view of a component of the hinge in FIG. 1.

This device 13 comprises, as shown in FIG. 2, a housing formed of an appropriately shaped casing 14 to allow fixing thereof to the box element 6, and of a bottom or base 26. Inside said housing there is inserted a braking disc 23, substantially flat in shape, immersed in a highly viscous medium, such as grease.

Advantageously, assembly of the damping device 13 and box element 6 can also take place by means of the same pins 7, 8, pivoting respectively about which are the second ends of the rockers 2 and 3, which pass through the corresponding holes 70, 71 of the casing 14, the holes 90, 91 of the bottom 26 and the holes 80, 81 of the box element 6.

The base of the casing 14 is provided with a hole or opening 15, substantially rectangular or square, to allow a cam connection element 16, fixed to the lower end of the rocker 3 pivoting about the pin 8 for articulation with the box element, or forming an integral part of said rocker, to engage by means of a hook 27 in corresponding spiral grooves 30 produced on the surface of the braking disc 23.

Advantageously, the hook 27 in turn pivots about a further pin 19 housed in the same cam element 16.

In the preferred embodiment of the hinge of the invention the cam connection element 16, better illustrated in FIGS. 7 and 8, is mounted on the rocker 3 by means of the articulation pin 8 and comprises lateral protuberances 22 which delimit a central cavity 18 and having through holes 17 thereon.

In the central cavity 18, about the pin 19 passing through the holes 17, there are housed the pivoting hook 27 and a torsion spring 20, the stems of which rest on the one side against the cam element 16 and on the other against the hook 27.

The torsion spring 20 stresses the hook 27 so that this latter rests with its abutments 28 abut against the back of the rocker 3. In a position diametrically opposite the abutments 28 with respect to the pin 19, the hook 27 is provided at one end thereof with a side tooth 29 which, once the hinge and the relative damping device are assembled, is engaged as a tappet element in the spiral grooves 30 of the disc 23, as shown in FIG. 3.

Advantageously, with the configuration of these elements described above, it is possible to take advantage of the characteristics, previously inefficiently combined in a single element, respectively of elasticity, through the presence of the torsion spring 20, and of rigidity, through the presence of the hook 27, advantageously made of metal or plastic or other suitable material, separately from each other.

During the closing movement of the hinge the rocker 3 pivots in the direction of the arrow 33, as shown in FIG. 3, and in the last portion of the movement thereof the tooth 29 of the hook 27, resting with the abutments 28 thereof against the back of the rocker 3, engages in one of the spiral grooves 30 of the disc 23 pushing against the vertical edge 31 thereof.

FIG. 4 shows a plan view of the disc 23 and the position of the hook 27, and of the relative side tooth 29, corresponding to the one in FIG. 3, is marked with a full line. Continuing the closing movement of the hinge, the hook 27 and the tooth 29 move respectively to the positions 27' and 29', marked with a dotted line, sliding along the vertical spiral edge 31 and causing the disc 23 to rotate counter-clockwise by an angle corresponding to the circular sector indicated by the dotted lines 40, 41. In the example in FIG. 4 this angle corresponds to 40°, the disc 23 being provided with nine spiral grooves 30. The plan shape of the grooves can also have a shape geometrically different to the spiral, providing the trend of the grooves allows linear motion, a component of the motion of the hook, to be transformed into a rotating or pivoting motion about the centre of the disc 23.

Instead, during the opening movement of the hinge, the rocker 3 pivots in the direction of the arrow 34, as shown in FIG. 5, and the back of the tooth 29 of the hook 27 rests against the edge 32 of the spiral groove 30, said edge 32 being inclined so as to cause pivoting of the hook 27 against the force of the spring 20. This pivoting allows the hook 27 to disengage from the groove 30 without causing rotation of the disc 23.

FIG. 6 shows a plan view of the disc 23 in which the position of the hook 27, and of the relative side tooth 29, corresponding to the one in FIG. 5, is marked with a full line. It can be observed that the vertical edge 31' of the groove subsequent to the one from which the tooth 29 is disengaging is in the position corresponding to the position of the vertical edge 31 in FIG. 4. In this way said subsequent groove can receive the tooth 29 in the subsequent closing movement of the door and produce a new decelerating rotation of the disc 23.

An advantageous expedient is to provide slots or holes 50 in the side walls of the bottom 26, besides the holes 90, 91 already provided for passage of the pins 7 and 8. Said holes 50 are suitable for connecting corresponding projections, not shown in the figures, provided on the box element 6 in order to facilitate pre-mounting of the pre-assembled damping device on the hinge.

Figure 1B:
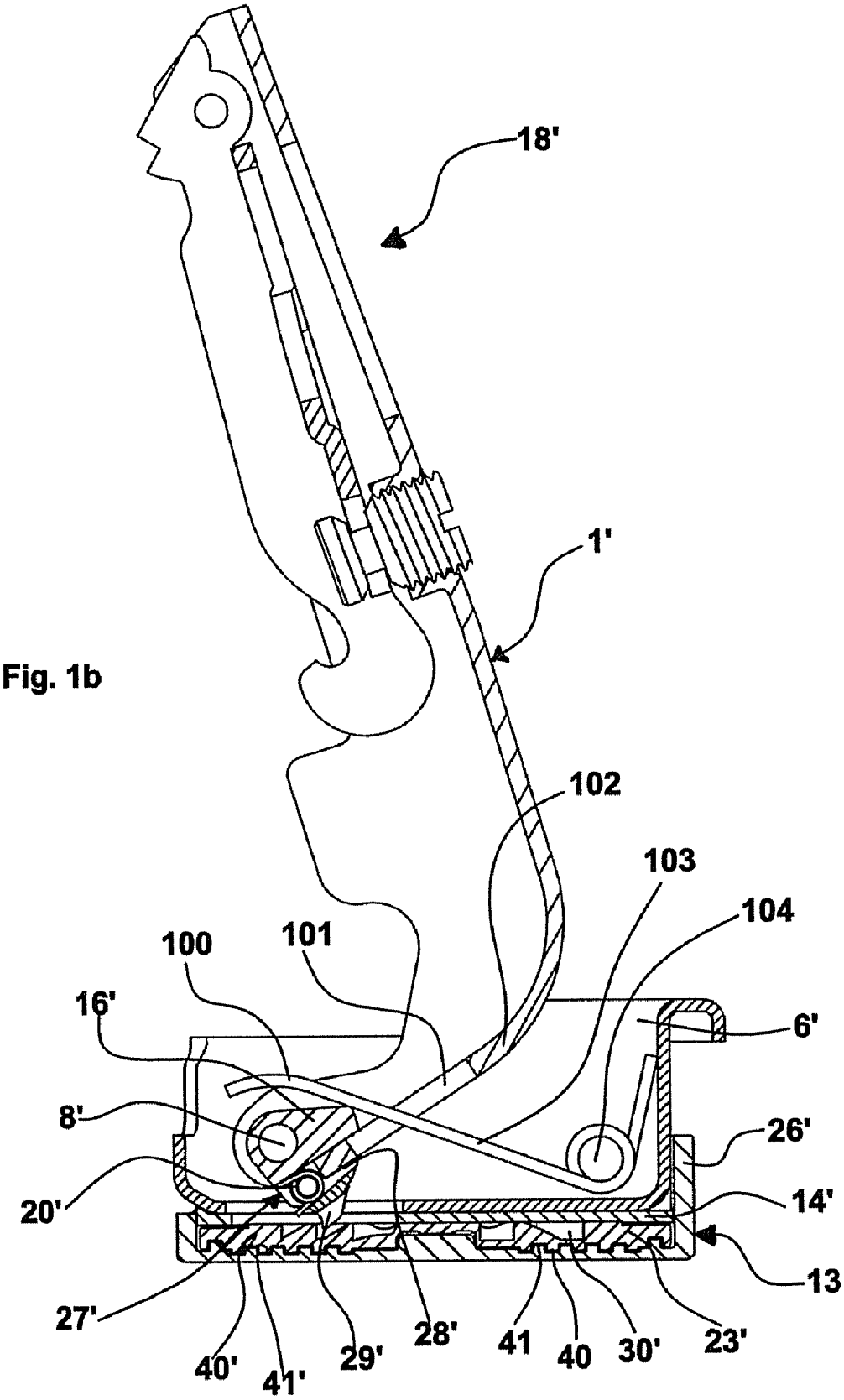
FIG. 1*b* shows a sectional view of a different embodiment of the hinge according to the invention in a half-open position.

A second embodiment of the invention provides for application of the same damping device 13 to a hinge 18' with one single articulation pin 8', shown in FIG. 1*b*.

Unlike the hinge 18 of the articulated quadrilateral type described previously, the hinges with one single pin are provided with a fixing arm 1', substantially L-shaped, comprising in a single block the arm 1 and the rocker 3 of the hinge 18, and suitable to pivot about the articulation pin 8' with the box element 6'. As is known, the rockers 2 and 3 and the other articulation pins 4, 7, 5 are therefore not provided. FIG. 1*b* shows a torsion spring 103 wrapped around a further transverse pin 104 and provided with an arm 100 which rests on an edge of the connection element 16', acting as a cam, in order to supply the closing thrust to the hinge. More appropriately, a pair of specular adjacent springs 103 can be provided, the central arms 100 of which passing through a central cavity 101 located in the bent part 102 of the fixing arm 1' of the hinge 18'.

Considering this second embodiment of the hinge, in FIGS. 3 and 5 the element indicated with the reference 3 represents, therefore, a portion or end of the L of the fixing arm 1'.

In this second embodiment, the cam connection element 16', fixed to the end or bent part 102 of the fixing arm 1' or which is an integral part of said end, engages by means of the side tooth 29' of the hook 27' in the corresponding grooves 30', produced in the surface of the braking disc 23' immersed in a highly viscous medium. The hook 27' is housed on the connection element 16' in the same way as described for the first embodiment and has the same configuration of the hook 27. Also in this embodiment the torsion spring 20' is advantageously provided, again housed in a central cavity of the connection element 16', with the stems of said spring 20' resting on the one side against the cam element 16' and on the other against the hook 27'. The torsion spring 20' stresses the hook 27' so that it rests with abutments 28' against the back of the bent part 102 of the fixing arm 1'.

In the same way as shown in FIG. 2, also in this second embodiment slots or holes can be provided in the side walls of the bottom 26', in addition to the holes provided respectively on the casing 14', on said bottom 26' and on the box element 6' for passage of the pin 8' which guarantees a quick fixing of the damping device 13 to the box element.

Therefore, with both embodiments of the hinge of the invention, the configuration of the pivoting hook and the presence of the elastic element, which can advantageously be a torsion spring, optimally satisfy the respective requirements of rigidity and elasticity which the slider of known damping devices is not capable of satisfying.

Advantageously, the facing surfaces of the braking disc and of the bottom or base, between which a viscous medium is provided also in this case, comprise in both embodiments a series of complementary annular concentric grooves 40', 40 and ribs 41', 41, which can be coupled as indicated in FIGS. 1*a* and 1*b*. The flat part of the crests of the ribs and the base of the grooves can, moreover, be produced with a rough finishing to promote adhesion of the viscous medium, for example high viscosity grease, in contact therewith. Advantageously, this embodiment makes it more difficult for the grease to move in a radial direction, so that the use of gaskets between the bottom and the box element of the hinge is unnecessary.

Besides eliminating possible shortages in the operation of the damping device, a further advantage of the hinge of the invention is to make the device 13 undoubtedly silent and the braking force more effective thanks to the increased extension of the coupled and friction surfaces with the viscous medium. In fact, the same braking effect obtained with known devices can be obtained using a smaller quantity of grease or, alternatively, an increased braking effect can be obtained with the same quantity of grease.

Advantageously, in both embodiments of the hinge, the box element is provided with:

- an opening 60 on the base or lower surface thereof to allow interaction of the connection element 16, 16', by means of the tooth 29, 29' of the hook 27, 27' with the braking disc 23, 23';
- and notches or indentations 61 on the side surface thereof which together with shelves 62, provided on the upper surface thereof and substantially having a shape of a circular crown portion, define a space suitable to house corresponding projections 63 of the casing 14, 14'.

The hinge of the invention also allows efficient operation without variation to the overall dimensions of standard hinges.

Advantageously, the production costs of the hinge of the invention are considerably low; in fact, the hinge described has a great advantage from the structural viewpoint, namely that it comprises a damping device which forms a separate body and can therefore be mounted, already assembled separately, on the box element.

The box element can be of the type normally used to produce standard hinges, for example produced simply by stamping and provided in some cases with projections of reference which do not prevent conventional use of the hinge without any damping and/or braking device. This device, already assembled, can be combined with the box element chosen in the final assembly phase of the hinge, the pins 7, 8 or the only pin 8' being advantageously the essential elements used for fixing thereof. Therefore, it is possible to produce the hinge of the invention provided with damping device without having to provide for particular operations with respect to assembly of standard hinges. In fact, only a single fixing operation is required to hold together the box element of the hinge and the damping device. Moreover, the latter has the advantage of disappearing entirely inside the thickness of the door and of being invisible from the outside.

The specific methods of production described herein do not limit the content of this application, which covers all the embodiments of the invention defined by the claims.

The invention claimed is:

1. Furniture hinge comprising:

a first member for the fixing thereof to a first piece of furniture, a second member for the fixing thereof to a door for said element of piece of furniture, said second member comprising a box member, said first member being connected to a first articulation pin in a pivoting motion with respect to said box member, connections means for connecting said first member to damping means for damping said pivoting motion, said damping means comprising a damping element immersed in a viscous medium for exerting a damping force to said first member, said damping element having a plurality of curved grooves at a first engaging surface thereof, said connection means further comprises a hook element connected to a second articulation pin, its axis parallel to an axis of said first articulation pin, elastic means for exerting an elastic pushing force onto said hook element, the arrangement being such that said hook under the biasing force of said elastic means exerts a pressure onto said damping element, said hook element is arranged to engage a curved groove of a said plurality of curved grooves of said damping element and, so as to convert the pivoting motion of the first member into a rotational motion of said damping element upon a rotation of the hinge.

2. Hinge according to claim 1, wherein the damping element includes a substantially flat disc shaped member.

3. Hinge according to claim 2, wherein said hook element comprises a tappet element suitable to follow the shape of the inside of a groove of each groove of said plurality of grooves of said damping element during at least a part of the pivoting motion of the first member.

4. Hinge according to claim 3, wherein the curve of each grove of said plurality of grooves of said damping element has a spiral shape.

5. Hinge according to claim 3, wherein the curve of each groove of said plurality of grooves of said damping element the groove has a circle shape.

6. Hinge according to claim 1, wherein said damping means comprises a flat disc shaped member and a housing for engaging said box member, said housing including a casing and a bottom member which enclose said flat disc shaped member, and provided with quick connection means, said casing and said bottom member being arranged so that said flat disc shaped member when assembled with said housing said damping means form a single element suitable to be fixed to said box member in a single mounting operation.

7. Hinge according to claim 6, wherein said quick connection means comprises articulation pins for engaging first holes onto said housing and second holes onto said box member and further including optional slots for a pre-mounting operation.

8. Hinge according to claim 6, wherein said bottom is provided with ribs and grooves which are complementary to corresponding grooves and ribs provided on a second surface face of said flat disc shaped member.

9. Hinge according to claim 1, wherein said damping means are provided within said box.

10. Hinge according to claim 1, wherein said first member includes two elements, the first element of said two elements being a fixing arm for the fixing thereof to said piece of furniture and the second element of said two elements further including a first rocker arranged for pivoting, about said first articulation pin with said box member and for pivoting about said second articulation pin with said fixing arm and a second rocker arranged for pivoting about a respective third articulation pin with said box and about a respective fourth articulation pin with said fixing arm.

* * * * *